US008686329B2

(12) United States Patent
Barry et al.

(10) Patent No.: US 8,686,329 B2
(45) Date of Patent: Apr. 1, 2014

(54) TORSION SPRING WING DEPLOYMENT INITIATOR

(75) Inventors: William D. Barry, Billerica, MA (US); Michael J. Krueger, Bedford, NH (US); Amy Pietrzak, Londonderry, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 167 days.

(21) Appl. No.: 13/378,183

(22) PCT Filed: Apr. 8, 2011

(86) PCT No.: PCT/US2011/031718

§ 371 (c)(1), (2), (4) Date: Dec. 14, 2011

(87) PCT Pub. No.: WO2011/127369

PCT Pub. Date: Oct. 13, 2011

(65) Prior Publication Data

US 2012/0119014 A1 May 17, 2012

Related U.S. Application Data

(60) Provisional application No. 61/322,461, filed on Apr. 9, 2010.

(51) Int. Cl.
*F42B 15/01* (2006.01)

(52) U.S. Cl.
USPC ..... 244/3.27; 244/3.24

(58) Field of Classification Search
USPC ..... 244/3.24–3.29, 49
See application file for complete search history.

(56) References Cited

U.S. PATENT DOCUMENTS

| | | | | |
|---|---|---|---|---|
| 3,918,664 | A | 11/1975 | Grosswendt | |
| 3,921,937 | A | 11/1975 | Voss et al. | |
| 3,990,656 | A * | 11/1976 | Minnich | 244/3.27 |
| 4,586,681 | A * | 5/1986 | Wedertz et al. | 244/49 |
| 4,635,881 | A * | 1/1987 | Brieseck et al. | 244/49 |
| 4,691,880 | A * | 9/1987 | Frank | 244/49 |
| 5,240,203 | A | 8/1993 | Myers | |
| 5,671,899 | A * | 9/1997 | Nicholas et al. | 244/49 |
| 6,119,976 | A * | 9/2000 | Rogers | 244/13 |
| 6,576,880 | B2 * | 6/2003 | Martorana et al. | 244/3.1 |
| 6,668,542 | B2 | 12/2003 | Baker et al. | |
| 6,880,780 | B1 * | 4/2005 | Perry et al. | 244/3.27 |
| 7,207,518 | B2 * | 4/2007 | Alculumbre et al. | 244/3.29 |
| 7,829,829 | B2 * | 11/2010 | King et al. | 244/3.25 |
| 2009/0127378 | A1 | 5/2009 | Turner et al. | |

* cited by examiner

*Primary Examiner* — Timothy D Collins
*Assistant Examiner* — Jamie S Stehle
(74) *Attorney, Agent, or Firm* — Maine Cernota & Rardin; Douglas P. Burum

(57) ABSTRACT

A compact, purely mechanical wing deployment assisting mechanism uses torsion springs and lever arms to apply a deploying force to a guidance wing during its initial deployment through a wing slot in a rocket or missile, thereby assisting the wing to burst through a cover seal protecting the wing slot. The wings are then fully deployed by centrifugal force. Various embodiments include two "extreme duty" springs and two lever arms per wing, working in parallel. Embodiments provide a total of at least 24 pounds of force per wing at the end of a spring travel of 0.30 inches. In some embodiments, the entire mechanism weighs less than 0.5 pounds and/or occupies less than 2.5 cubic inches per wing. In embodiments, an assembled group, including two springs and two lever arms, is located between each pair of wings, whereby each assembled group applies one lever arm to each adjoining wing.

12 Claims, 21 Drawing Sheets

Detail H

Detail T

Detail P

TORSION SPRING WING DEPLOYMENT INITIATOR

RELATED APPLICATIONS

This application claims the benefit of U.S. Provisional Application No. 61/322,461, filed Apr. 9, 2010, herein incorporated by reference in its entirety for all purposes.

STATEMENT OF GOVERNMENT INTEREST

The invention was made with United States Government support under Contract No. W31P4Q-06-C-0330 awarded by the Navy. The United States Government has certain rights in this invention.

FIELD OF THE INVENTION

The invention relates to ballistic weaponry, and more particularly to apparatus for deploying guidance wings on folding fin aerial rockets and missiles.

BACKGROUND OF THE INVENTION

Aerial rockets and missiles which include folded, deployable guidance wings have been in use at least since the late 1940's, with the FFAR (Folding Fin Aerial Rocket) being used in the Korean and Vietnam conflicts, and the more recent Hydra 70 family of WAFAR (Wrap-Around Fin Aerial Rocket) and Advanced Precision Kill Weapon System (AP-KWS) laser guided missile. For many such weapons, the guidance wings are folded in a stowed configuration within the main fuselage until the weapon is launched, at which point the wings deploy outward through slots provided in the fuselage.

Typically, a rocket or missile is spun during its flight for increased accuracy and stability. For many missiles and rockets with folded, deployable guidance wings, the guidance wings are released from their folded and stowed configuration upon launch, and are deployed by the centrifugal force which results from the spinning of the weapon in flight. In some cases, the wing slots are covered by frangible seals which protect the interior of the missile from moisture and debris during storage, transport, and handling. In these cases the guidance wings must be deployed with sufficient initial force to enable them to penetrate the seals.

Clearly, wing deployment through frangible cover seals becomes more dependable as the initial deployment force is increased. However, there is a practical limit to how rapidly a missile can be spun. In one example, the average centrifugal force on the tip of a guidance wing at the beginning of deployment is only approximately 7.7 pounds at the minimum spin rate. This amount of centripetal energy may not be sufficient by itself to enable the wings to burst through the frangible slot covers. As a result, some weapons that include deployable folded guidance wings and frangible wing slot covers have demonstrated a tendency for the guidance system to fail due to a lack of proper guidance wing deployment. This problem can be addressed by a wing deployment initiator, which assists the deployment of the guidance wings by providing an initial burst of energy to help the wings break through the frangible covers.

In some designs, the wing deployment initiator uses explosives to push the wings through the frangible covers. However, this approach can be undesirable due to the violent forces produced by the explosives, and due to concerns about the safety and the long-term chemical stability of the explosives during storage of the weapon.

A mechanical solution would be desirable. However, only very limited space is available for a wing deployment initiator to occupy. Also, the weight of the deployment initiator must be as low as possible. Therefore, it can be very difficult to provide a mechanical wing deployment initiator which can provide sufficient force to enable the guidance wings to break through the frangible covers while also fitting within the available space and remaining sufficiently light in weight.

What is needed, therefore, is a mechanical wing deployment initiator which will not add excessive weight to a missile or rocket, will fit within available space within the guidance wing storage region of the missile or rocket, and will provide sufficient added force during the initial guidance wing deployment so as to ensure that the wings are reliably able to burst through frangible wing slot cover seals and be fully deployed.

SUMMARY OF THE INVENTION

The present invention is a mechanical wing deployment initiator for use with missiles and rockets which include deployable folded guidance wings. The deployment initiator provides added wing deployment force during the initial stage of wing deployment, so as to ensure that the guidance wings are able to burst through frangible seals covering the wing slots. Once the wings have burst through the seals, they are able to be fully and successfully deployed by the centrifugal force supplied by the spinning of the rocket or missile. In one embodiment, the deployment mechanism provides 24 pounds of initial deployment force, which is added to approximately 7 pounds of centrifugal force supplied by the spinning of the missile.

The wing deployment mechanism of the present invention is light in weight and fits into a limited space within the guidance wing storage region of the missile or rocket. It uses a combination of torsion springs and lever arms to apply the required additional deployment force to the guidance wings as they break through the cover seals. In embodiments, each of the guidance wings is pushed by two "extreme duty" torsion springs and two lever arms.

In some of these embodiments, the torsion springs and lever arms are combined into compactly assembled groups, whereby each assembled group includes a bracket on which are mounted two torsion springs and two lever arms. In these embodiments, the total number of assembled groups is equal to the total number of guidance wings, with one such assembled group being located between each pair of wings. For each of the assembled groups, one of the two lever arms pushes on the wing which is adjacent on the left, and the other lever arm pushes on the wing which is adjacent on the right, so that the two lever arms pivot about axes which differ in direction by an angle of 360°/N, where N is the number of guidance wings. For example, if there are four guidance wings, the two lever arms in each assembled group pivot about axes which differ in angle by 90°. Each wing in these embodiments is thereby pushed by two torsion springs and two lever arms, one of the springs and one of the lever arms being part of the assembled group which is adjacent to the wing on the left side, and the other spring and lever arm being part of the assembled group which is adjacent to the wing on the right side.

In various embodiments, the two springs working in parallel create a mechanical advantage providing 24 pounds of force to each wing at the end of the spring travel, where the total spring travel is 0.30 inches. In embodiments, the lever arms focus the applied forces at the most accessible regions of the wings, which may not be near the ends of the wings.

In some embodiments, the entire wing deployment mechanism weighs less than ½ pound and occupies less than 2.5 cubic inches per wing.

The present invention is a wing deployment initiating mechanism for increasing an initial deployment force applied to a guidance wing of a rocket or missile so as to propel the guidance wing outward from a stowed configuration at least through an initial phase of movement toward a deployed configuration of the guidance wing. The wing deployment initiating mechanism includes at least one lever arm pivotally fixed to the rocket or missile, the lever arm being cooperative with the guidance wing so as to propel the guidance wing outward from the stowed configuration when the lever arm is pivoted outward, and at least one torsion spring cooperative with the lever arm and configured to apply a deploying force tending to pivot the lever arm outward.

In embodiments, the torsion spring is an extreme duty torsion spring.

In various embodiments, each guidance wing is propelled by two lever arms and two torsion springs. In some of these embodiments a first lever arm, a second lever arm, a first torsion spring, and a second torsion spring are included in a compact assembly. In certain of these embodiments the wing deployment assisting mechanism includes N compact assemblies, where N is the number of guidance wings included in the rocket or missile. In various of these embodiments a compact assembly is located between each pair of adjacent guidance wings. In some of these embodiments for each of the compact assemblies, the first torsion spring and the first lever arm apply a deploying force to the guidance wing on a first side of the compact assembly; and the second torsion spring and the second lever arm apply a deploying force to the guidance wing on a second side of the compact assembly. And in certain of these embodiments the first and second lever arms pivot about axes which differ in angle by 360°/N.

In various embodiments the deploying force is sufficient to enable the guidance wing to break through a frangible seal covering a wing slot in a fuselage of the rocket or missile.

In some embodiments the mechanism applies at least 24 pounds of deploying force to the wing at the end of a spring travel of 0.30 inches. In certain embodiments, the wing deployment assisting mechanism weighs less than 0.5 pounds. And in other embodiments the wing deployment assisting mechanism occupies less than 2.5 cubic inches per wing.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a wing deployment initiating mechanism which provides added wing deployment force during the initial deployment of guidance wings on folded wing missiles and rockets, so as to augment the centrifugal wing deployment force during the initial phase of wing deployment and ensure that the wings are able to break through frangible seals which cover the wing deployment slots. After bursting through the seals, the wings are fully deployed by the centrifugal force which arises from the spinning of the missile in flight.

Figure 1:
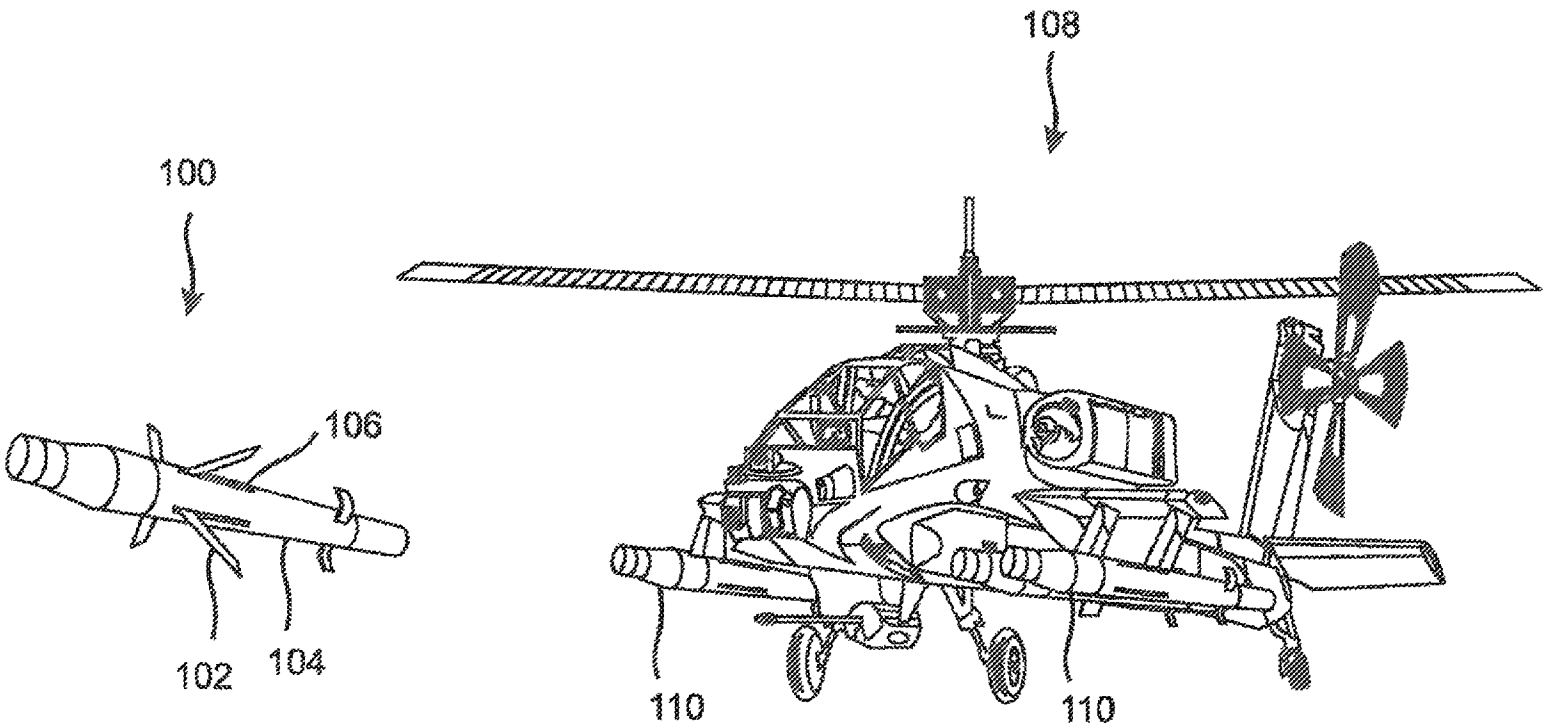
FIG. 1 is a perspective view of an APKWS having just been launched from a helicopter, showing its guidance wings deployed.

With reference to FIG. 1, some aerial rockets and missiles 100 include guidance wings 102 which are typically folded within the main fuselage 104 in a stowed configuration until the weapon is launched, at which point the wings 102 are released and deployed through wing slots 106. One example is the Advanced Precision Kill Weapon System (APKWS) laser guided missile 100. FIG. 1 illustrates an APKWS 100 having just been launched from a helicopter 108, with its guidance wings 102 deployed. Additional APKWS missiles 110 are shown still attached to the helicopter 108 with their guidance wings not yet deployed. The wing slots 106 in these missiles 110 are covered by frangible cover seals, which protect the interior of the missile from dirt and debris before missile launch. Deployment of the guidance wings 102 therefore requires sufficient initial force to enable the wings 102 to break through the frangible cover seals.

Some rockets or missiles that include guidance wings have demonstrated a tendency for the guidance system to fail due to a failure of the guidance wings to break through the frangible wing covers, and a resultant lack of proper wing deployment. This problem has been addressed in some designs by explosive deployment mechanisms. However, the sudden, violent force delivered by such mechanisms is not optimal, and the safety and long term chemical stability of the explosives can be a concern.

Figure 2:
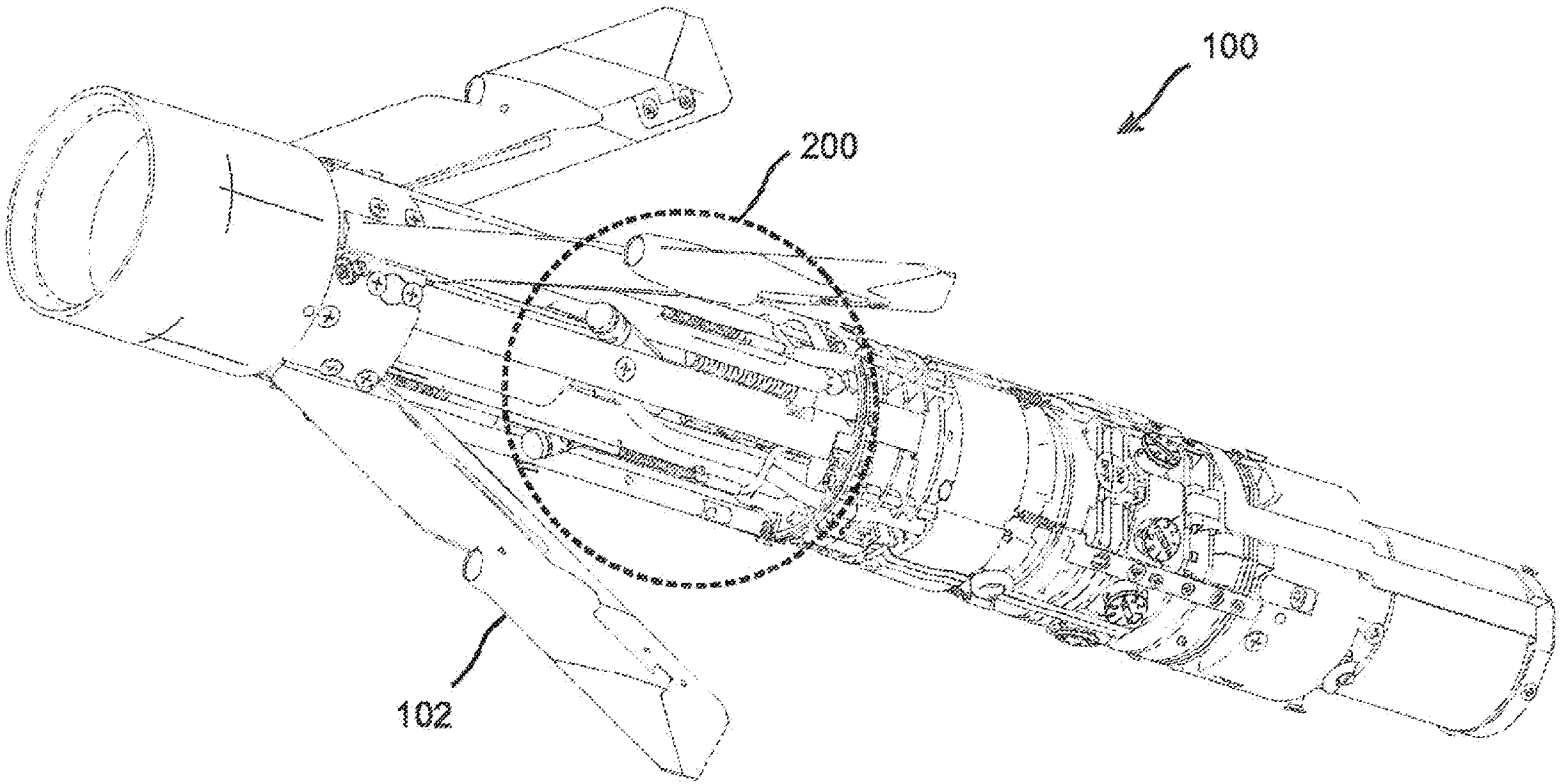
FIG. 2 is a perspective view showing the location of the guidance wing storage region of the present invention in an APKWS missile.

The present invention addresses the problem of guidance wing deployment through a frangible cover seal by providing a purely mechanical wing deployment initiator which uses torsion springs to assist in the bursting of the guidance wings through the frangible wing slot covers. FIG. 2 illustrates the guidance wing storage region 200 where an embodiment of the present invention is located within an APKWS missile 100.

Figure 3B:
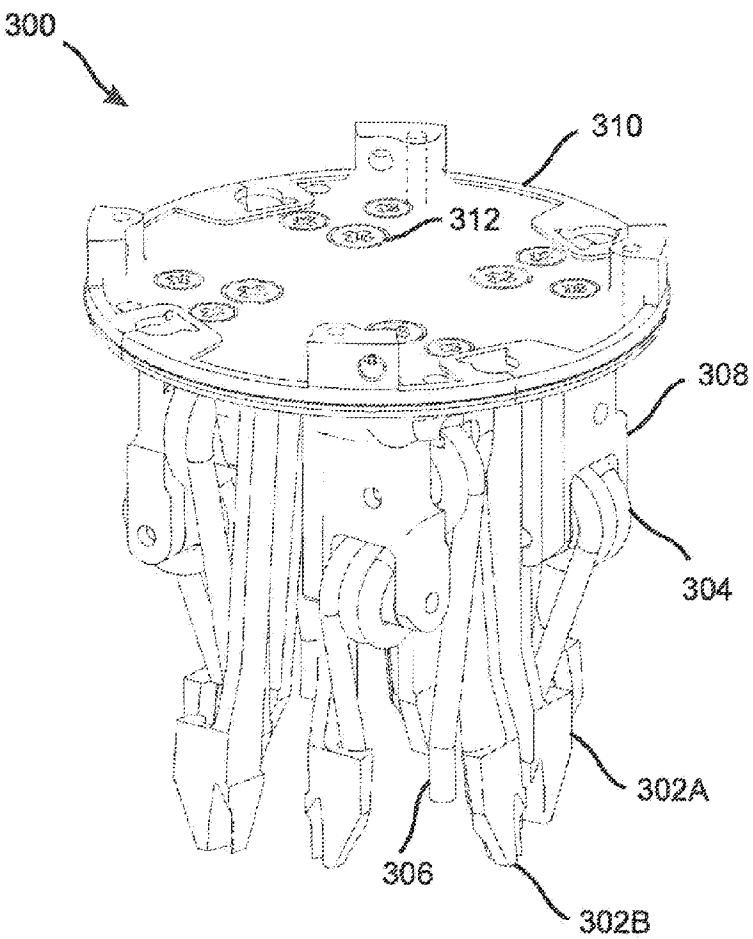
FIG. 3B is a perspective view of an embodiment of the present invention shown outside of the missile in the vertical orientation of FIG. 3A.
Figure 3A:
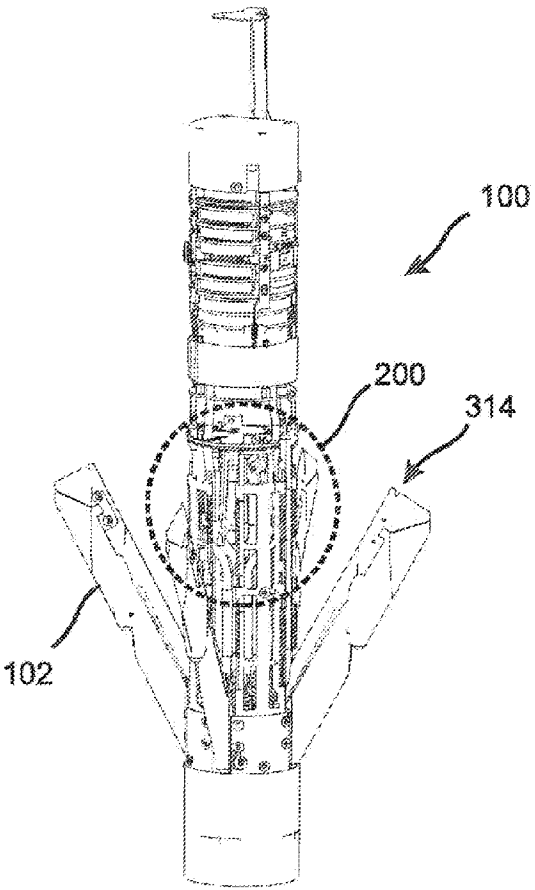
FIG. 3A is a perspective view showing the APKWS missile of FIG. 2 in a vertical orientation.

FIG. 3A is a perspective view of the APKWS missile 100 of FIG. 2 in a vertical orientation facing downward. FIG. 3B illustrates a torsion spring wing deployment initiator embodiment of the present invention as it appears when it is not installed in a missile, the embodiment being shown in an orientation which corresponds with FIG. 3A. The torsion spring wing deployment initiator embodiment 300 of FIG. 3B includes 8 lever arms 302A, 302B, and 8 torsion springs 304, 306, whereby each lever arm 302A, 302B is driven by a torsion spring 304, 306 and each wing 102 is pushed by a pair of lever arms 302A, 302B and torsion springs 304, 306 to initiate its deployment. The torsion springs in the embodiment of FIG. 3B are classified as "extreme duty" springs which support end of life requirements. The lever arms 302A, 302B and torsion springs 304, 306 are supported by four brackets 308 which are fastened by screws 312 to an aft retainer plate 310. Before deployment, the wings 102 are locked in their stowed position by tabs on the aft retainer plate 310 which engage with notches 314 provided in the wings.

The present invention must provide sufficient wing initiating force to enable the wings 102 to break through the cover seals, while also being able to fit into the available space within the guidance wing storage region 200 of the missile 100. FIG. 4A is a perspective view of a collection of components which can be assembled into a compactly assembled group 400 of springs and lever arms for installation within the guidance wing storage region. The embodiment 300 of FIG. 3B includes four of these assembled groups 400, which are mounted by screws to the aft retaining plate 310 and located in the spaces between the four guidance wings 102. Each assembled group 400 of components includes two lever arms 302A, 302B, and two torsion springs 304, 306. The torsion springs 304, 306 are rotatably mounted on mandrels 402 which pivot about mounting pins 404. The lever arms 302A, 302B pivot about lever arm pins (see 600A, 600B of FIG. 6A) which are attached to the bracket 308 and inserted into mounting holes 406A, 406B at the ends of the lever arms 302A, 302B.

Figure 4B:
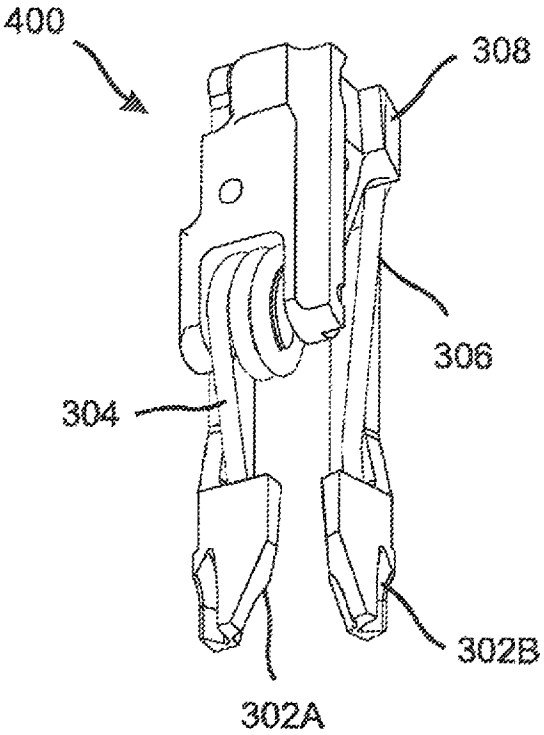
FIG. 4B is a perspective view of the assembled group resulting from assembly of the components of FIG. 4A.
Figure 4A:
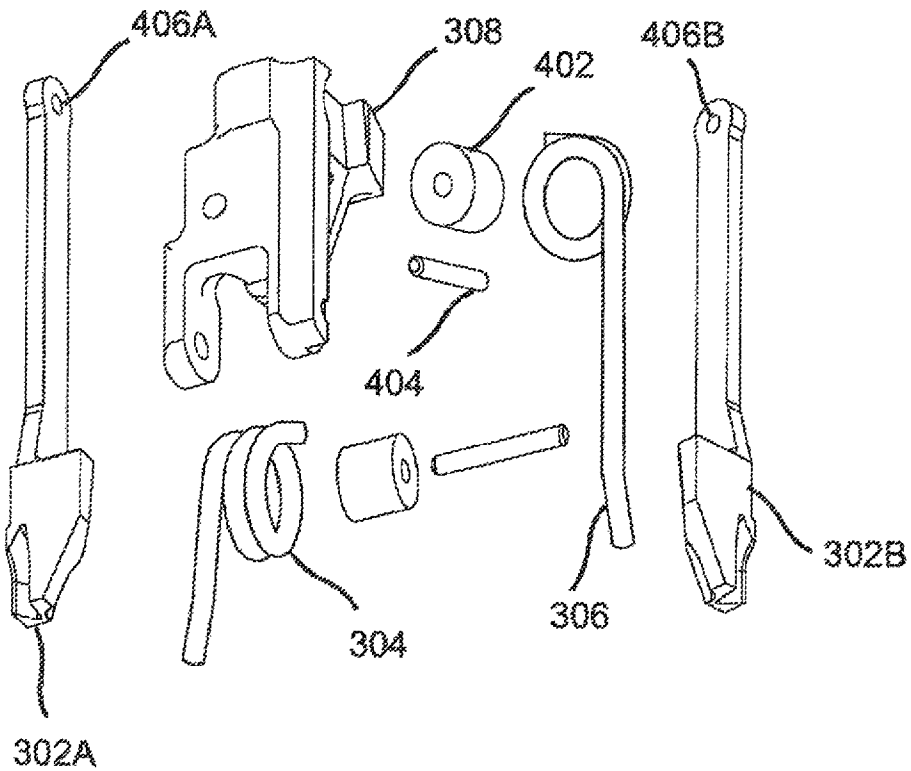
FIG. 4A is an perspective view of the disassembled components of an assembled group of springs and lever arms from the embodiment of FIG. 3B.

FIG. 4B illustrates the assembled group 400 of parts which results when the components of FIG. 4A are assembled. It can be seen in FIG. 4B that the two lever arms 302A, 302B pivot about axes which differ in direction by 90°, so that one of the lever arms 302A and torsion springs 304 pushes on the wing 102 which is adjacent to the assembled group 400 on the left, and the other lever arm 302B and torsion spring 306 pushes on the wing 102 which is adjacent to the assembled group 400 on the right. Accordingly, each wing 102 is pushed by two lever arms 302A, 302B, one from the assembled group 400 on the right side of the wing 102, and the other from the assembled group 400 on the left side of the wing 102.

The deployment mechanism of this embodiment provides 24 pounds of force to each wing at the end of the spring travel, which is 0.30 inches. This is added to approximately 7 pounds of centrifugal force supplied by the spinning of the missile at its minimum spinning rate. The embodiment weighs less than 0.5 pounds, and occupies less than 2.5 cubic inches per wing. In similar embodiments with N wings, where N is an integer, there are N assemblies 400, and the springs pivot about axes which differ in angle by 360°/N.

Figure 5B:
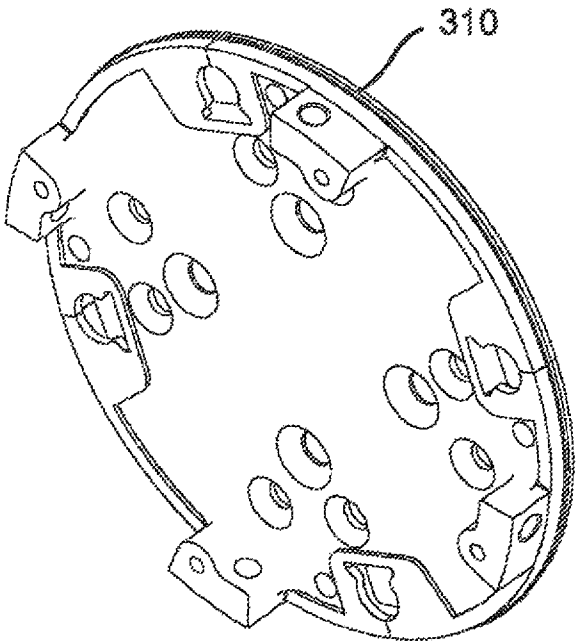
FIGS. 5A through 5K are engineering drawings which illustrate the design of an aft wing retaining plate of an embodiment of the invention.
Figure 5A:
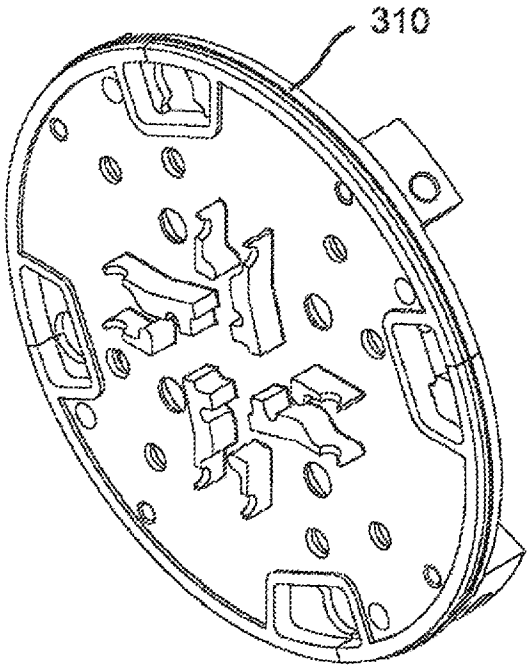
Figure 5D:
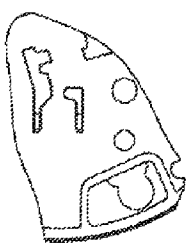
Figure 5D:
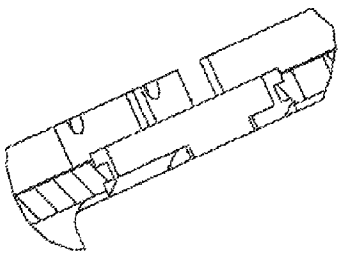
Figure 5C:
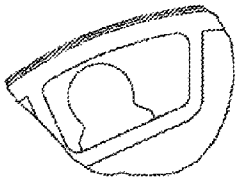
Figure 5C:
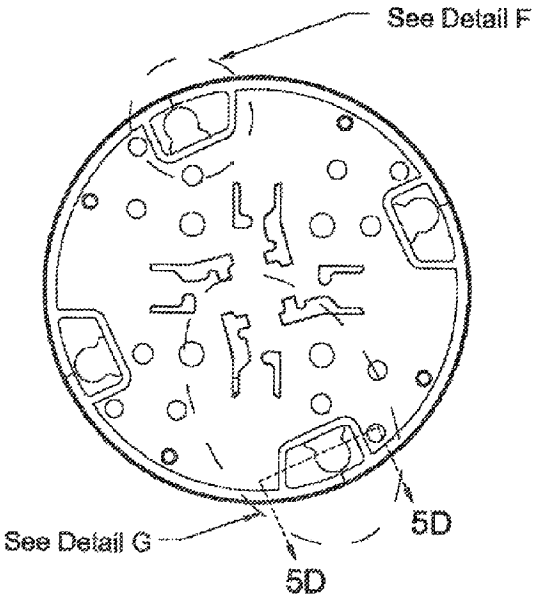
Figure 5E:
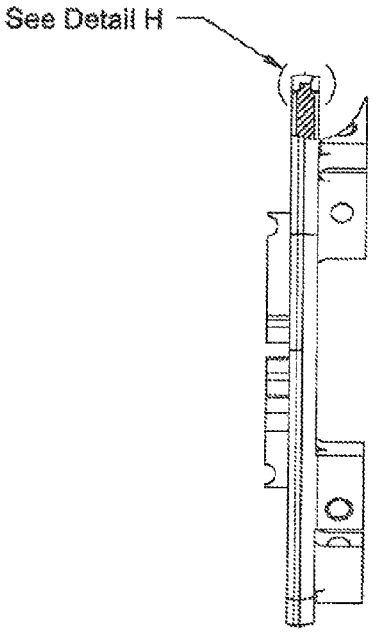
Figure 5E:
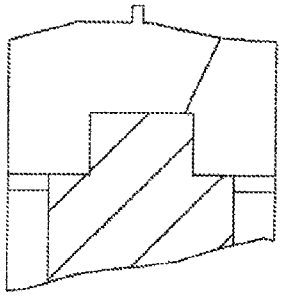
Figure 5F:
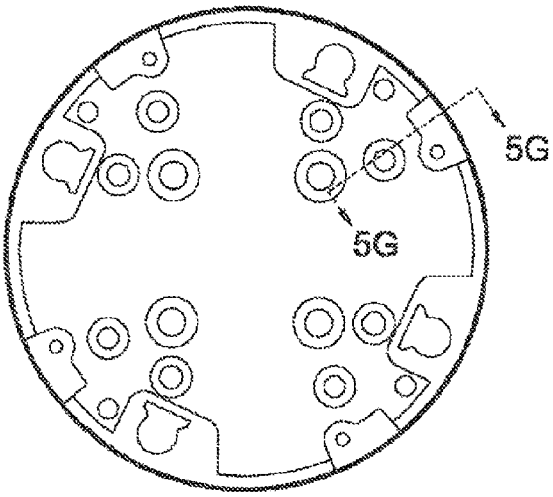
Figure 5G:
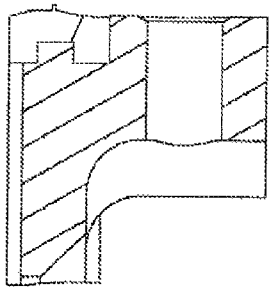
Figure 5I:
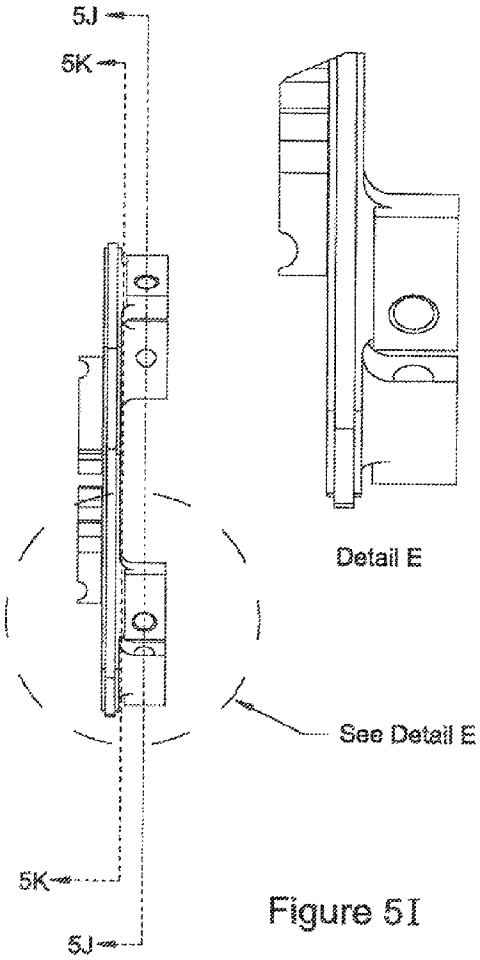
Figure 5H:
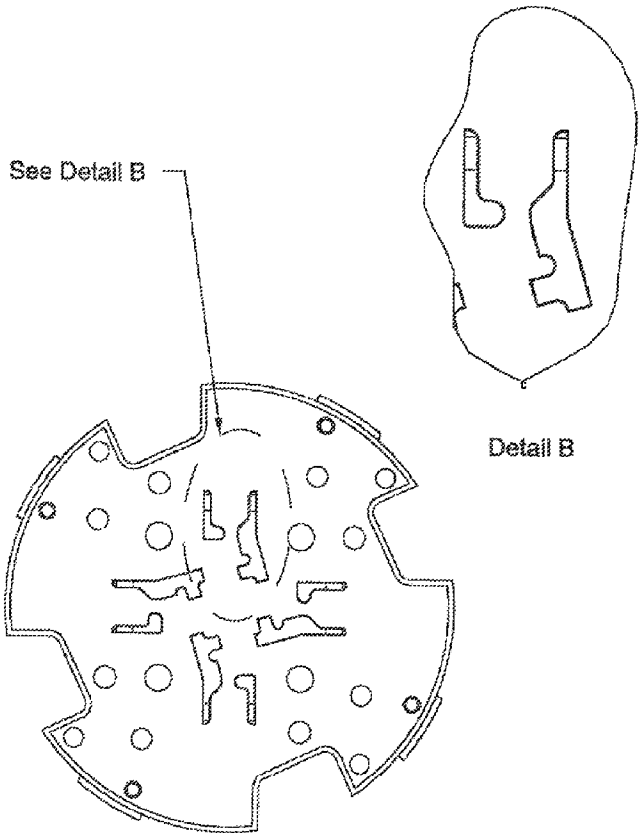
Figure 5K:
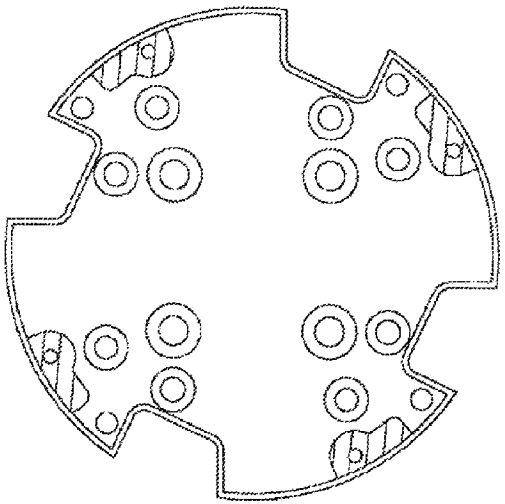
Figure 5J:
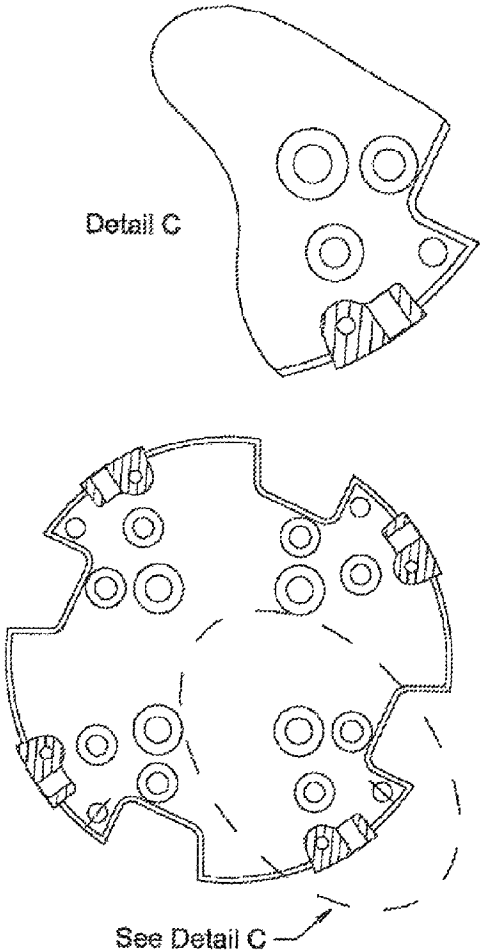

FIGS. 5A and 5B are top and bottom perspective views respectively of the aft retainer plate 310 of the embodiment of FIG. 3B. Note that the embodiment in FIG. 3B is oriented as it would be when mounted in a missile facing downward, so that the "top" of the aft retainer plate 310 faces downward in FIG. 3B. The aft retainer plate of FIGS. 5A and 5B is assembled from a top layer and a bottom layer. FIG. 5C through 5G are engineering drawings of the fully assembled aft retainer plate 310 of FIGS. 5A and 5B. In particular, FIG. 5C is a top view, FIG. 5E is a side view, and FIG. 5F is a bottom view. FIG. 5H is a top view of the top layer of the aft retainer plate 310, FIG. 5I is a side view of the top layer of the aft retainer plate 310, and FIG. 5J is a bottom view of the top layer of the aft retainer plate 310. FIG. 5K is a bottom view of the bottom layer of the aft retainer plate 310.

Figure 6C:
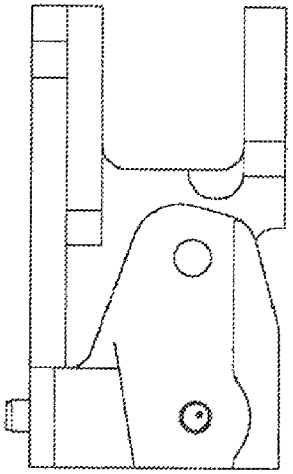
FIGS. 6A through 6M are engineering drawings which illustrate the design of the bracket of the assembled group of FIG. 4A.
Figure 6B:
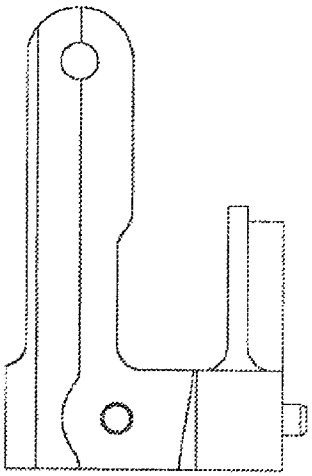
Figure 6D:
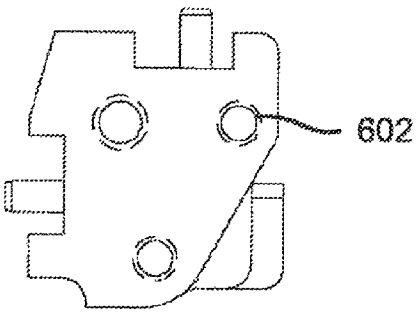
Figure 6A:
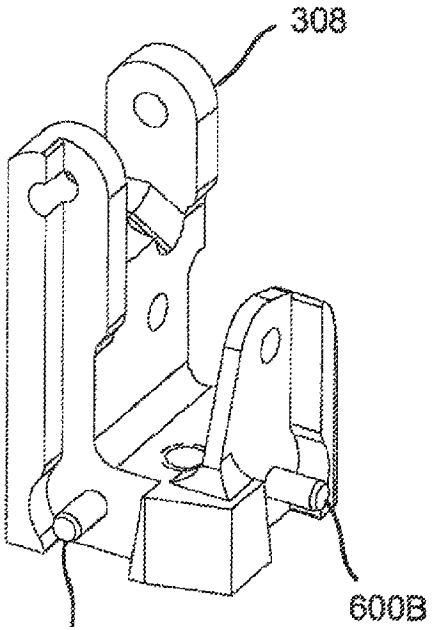

FIG. 6A is a perspective view from behind of the bracket 308 of FIG. 3B. The two lever arm pins 600A, 600B on which the pivot holes 406A, 406B of the lever arms 302A, 302B are mounted can be clearly seen in the figure. FIGS. 6B, 6C, and 6D are side, rear, and bottom views respectively of the bracket 308. Note that the holes 602 through which the mounting screws are inserted are clearly visible in FIG. 6D.

Figure 6E:
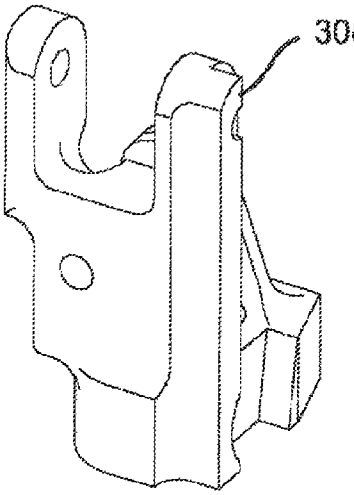
Figure 6F:
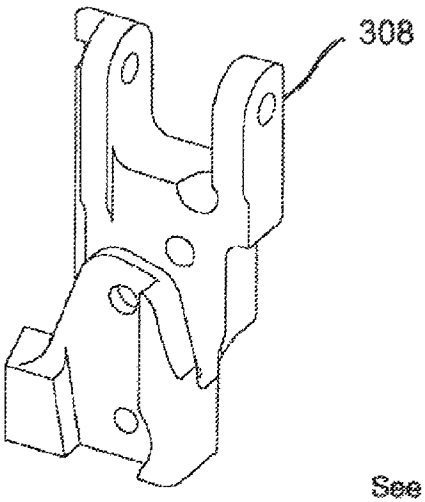
Figure 6G:
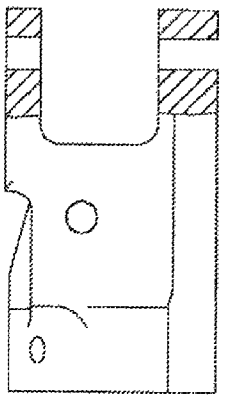
Figure 6H:
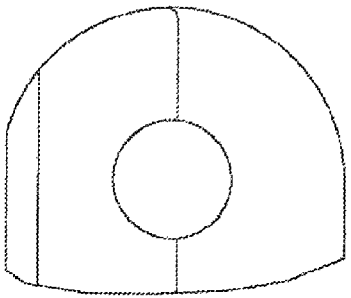
Figure 6H:
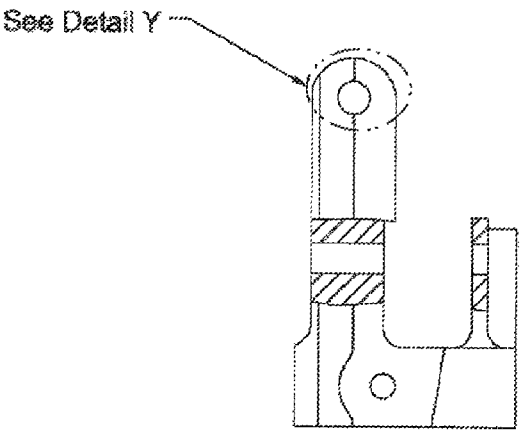
Figure 6I:
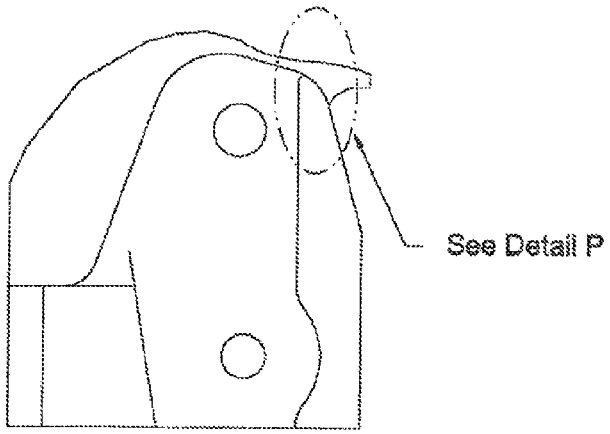
Figure 6I:
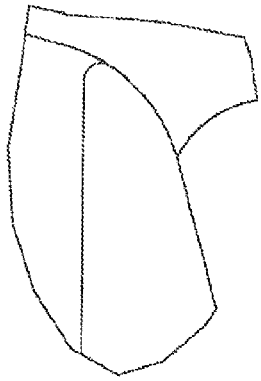
Figure 6I:
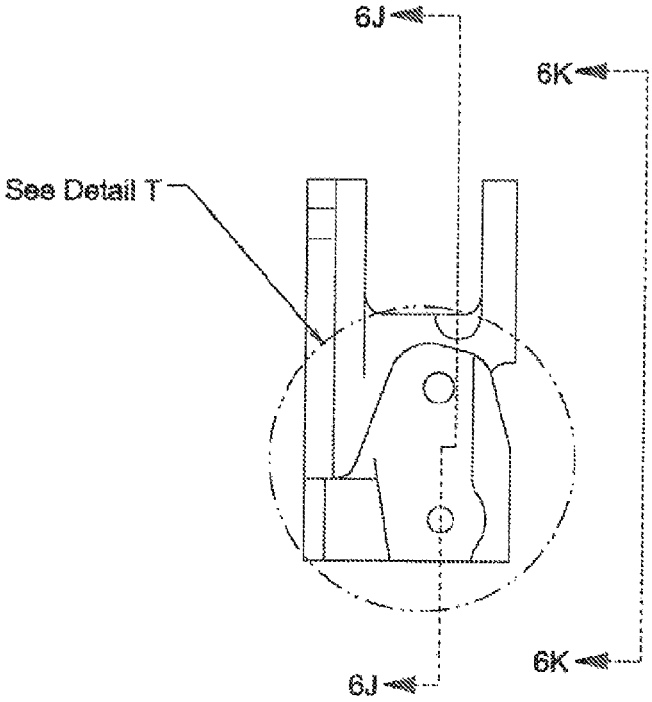
Figure 6J:
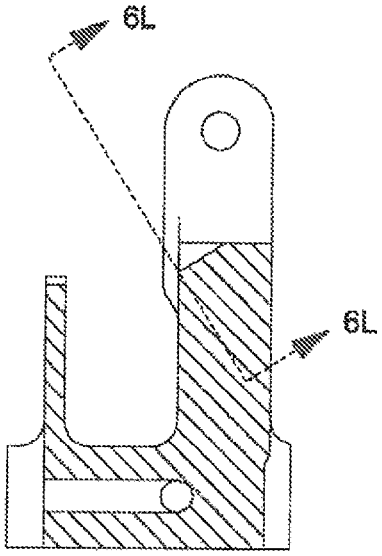
Figure 6L:
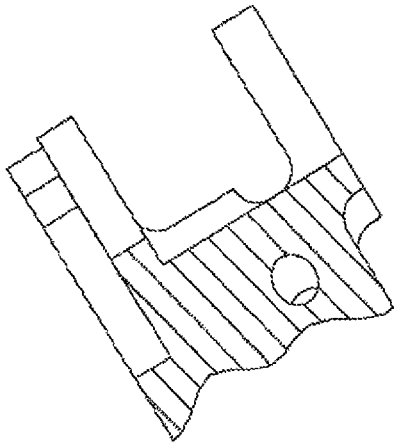
Figure 6K:
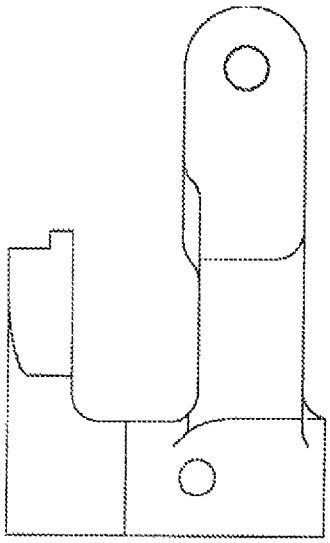
Figure 6M:
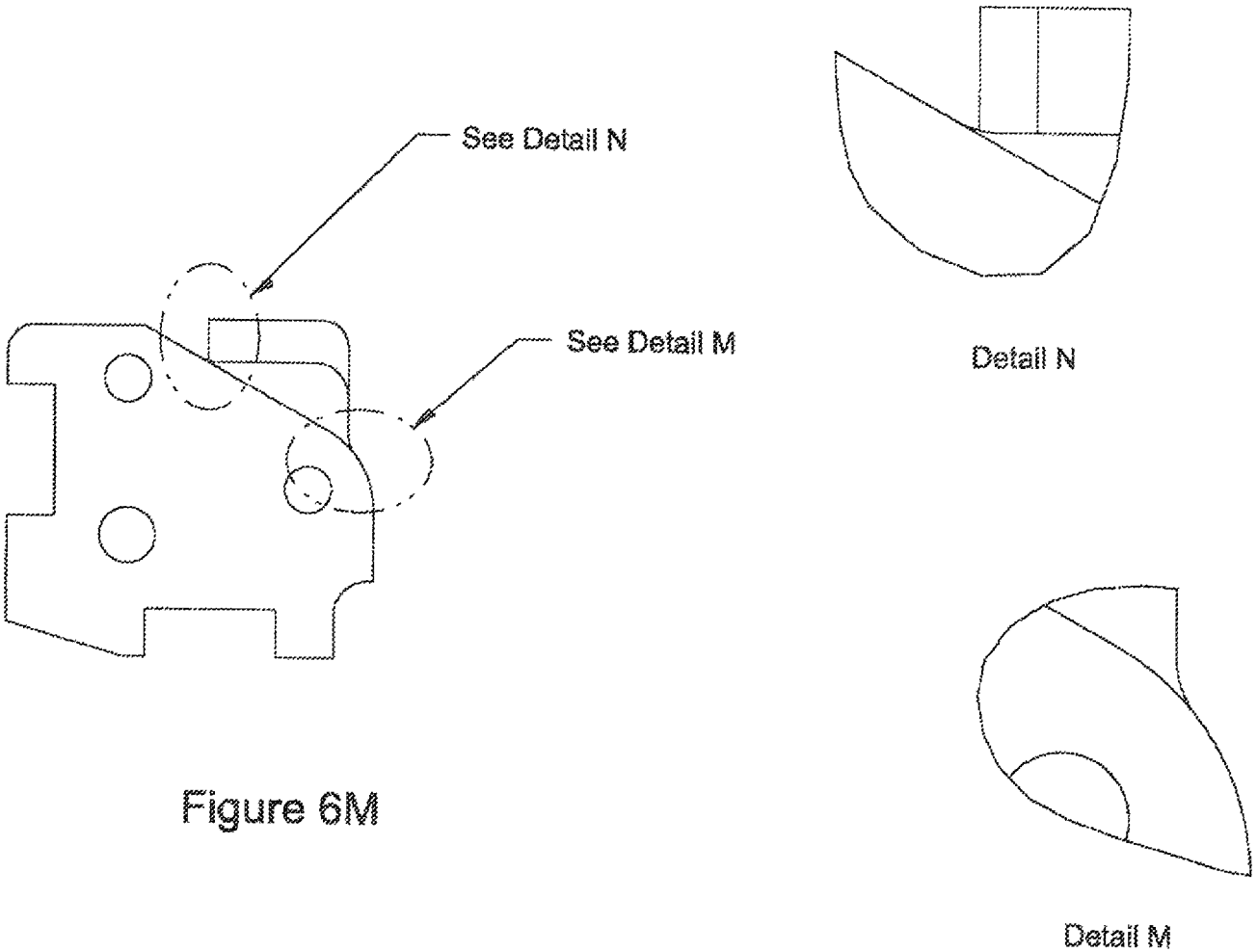

FIG. 6E is a front perspective view, FIG. 6F is a rear perspective view, FIG. 6I is a side view, and FIGS. 6G and 6H are cross-sectional views of the bracket of FIG. 6A with the lever arm pins 600A, 600B removed. FIGS. 6K through 6M are additional engineering views of the bracket 308 of FIG. 6A.

Figure 7D:
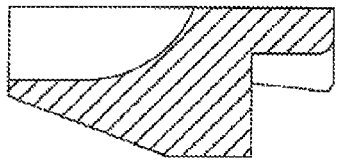
FIGS. 7A through 7E are engineering drawings which illustrate the design of the first lever arm of the assembled group of FIG. 4A.
Figure 7E:
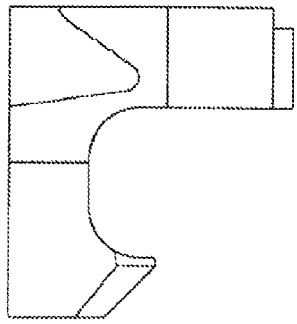
Figure 7C:
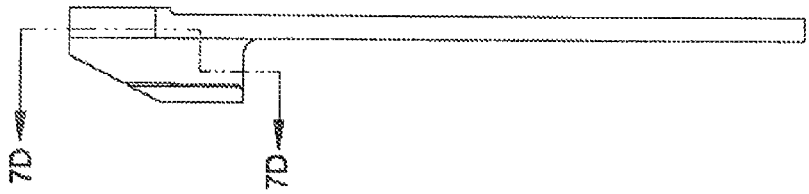
Figure 7B:
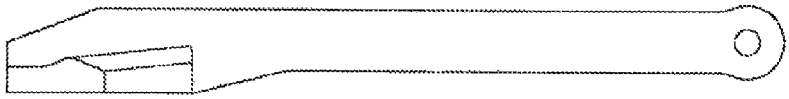
Figure 7A:
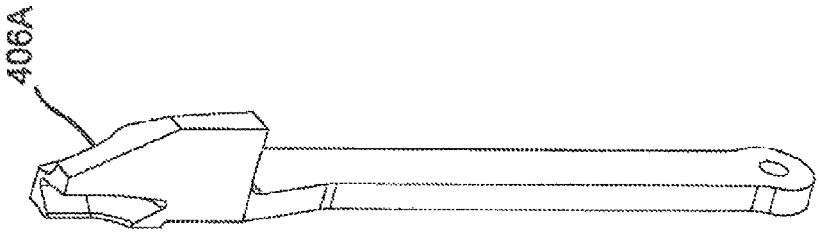

FIG. 7A is a perspective view of the first lever arm 406A of the embodiment of FIG. 3B, and FIGS. 7B through 7E are engineering drawings of the lever arm of FIG. 7A, with FIGS. 7B, 7C, and 7E being side, front, and top views, respectively.

Figures 8A, 8B, 8C, 8D, 8E:
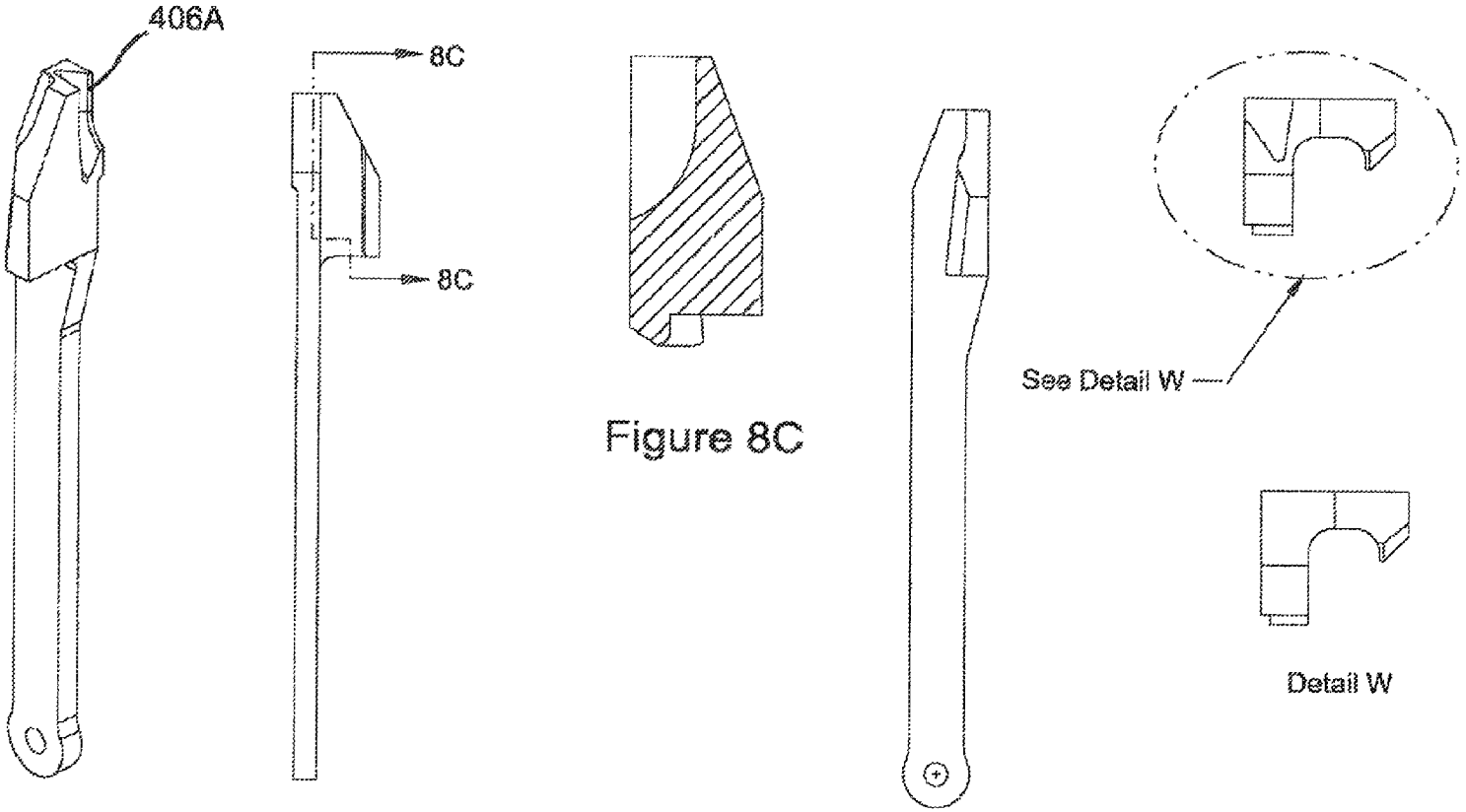
FIG. 8A through 8E are engineering drawings which illustrate the design of the second lever arm of the assembled group of FIG. 4A.

FIG. 8A is a perspective view of the second lever arm 406B of the embodiment of FIG. 3B, and FIGS. 8B through 8E are engineering drawings of the lever arm of FIG. 8A, with FIGS. 8B, 8C, and 8E being side, front, and top views, respectively.

Figure 9B:
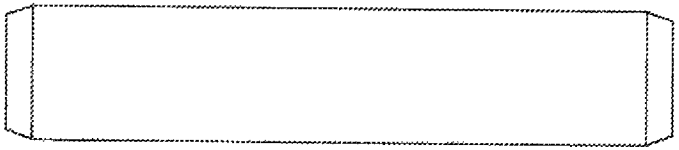
FIGS. 9A through 9C are engineering drawings which illustrate the design of the pivot pins of the assembled group of FIG. 4A.
Figure 9C:
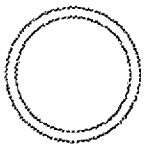
Figure 9A:
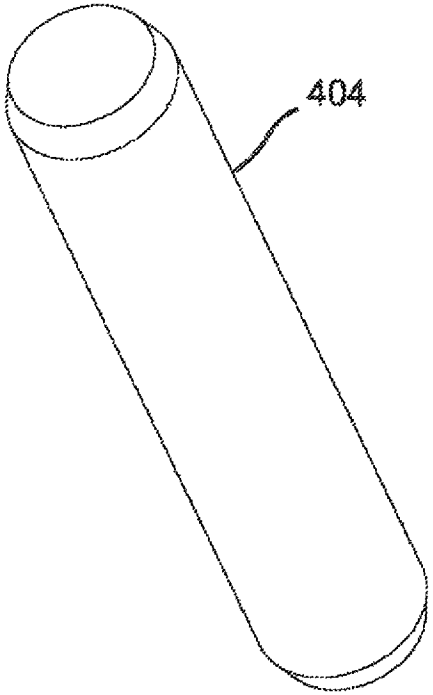

FIG. 9A is a perspective view of a lever arm mounting pin 404 of the embodiment of FIG. 3B, and FIGS. 9B and 9C are side and end views respectfully of the mounting pin 404 of FIG. 9A.

Figure 10B:
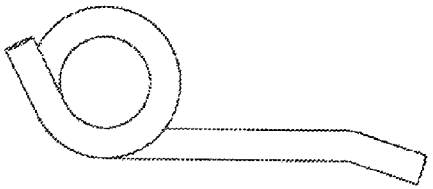
FIGS. 10A through 10D are engineering drawings which illustrate the design of the first torsion spring of the assembled group of FIG. 4A.
Figure 10C:
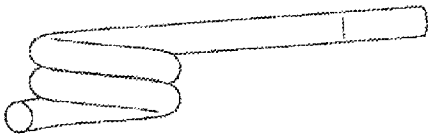
Figure 10D:
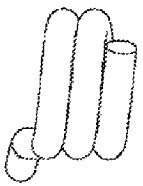
Figure 10A:
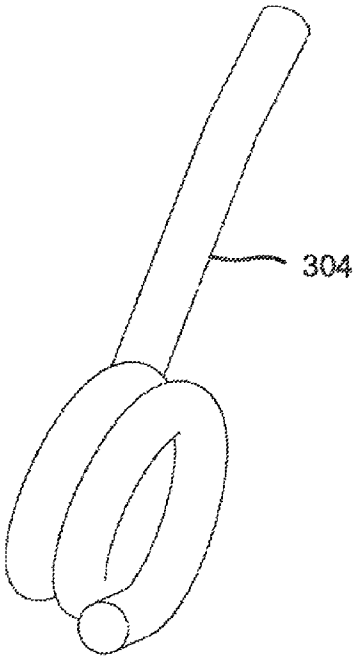

FIG. 10A is a perspective view of the first torsion spring 304 of the embodiment of FIG. 3B. FIGS. 10B through 10D are side, top, and front views respectfully of the torsion spring 304 of FIG. 10A.

Figure 11B:
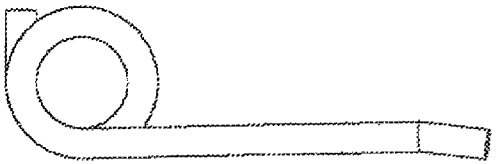
FIGS. 11A through 11D are engineering drawings which illustrate the design of the second torsion spring of the assembled group of FIG. 4A.
Figure 11C:
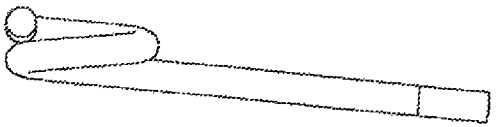
Figure 11D:
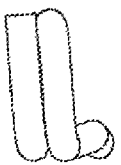
Figure 11A:
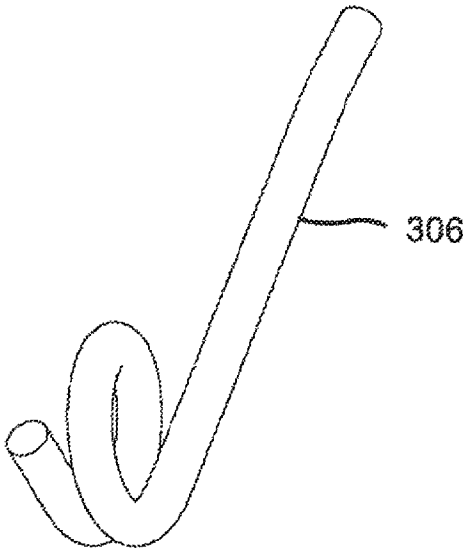

FIG. 11A is a perspective view of the second torsion spring 306 of the embodiment of FIG. 3B. FIGS. 11B through 11D are side, top, and front views respectfully of the torsion spring 306 of FIG. 11A.

Figure 12C:
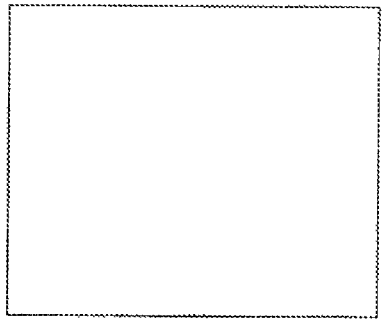
FIGS. 12A through 12C are engineering drawings which illustrate the design of the spring mandrels of the assembled group of FIG. 4A.
Figure 12B:
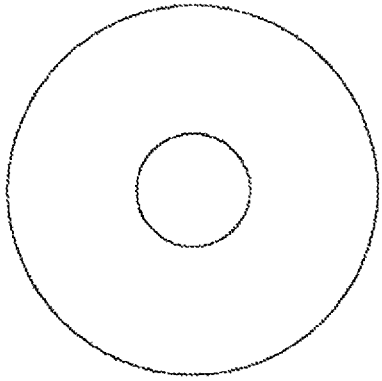
Figure 12A:
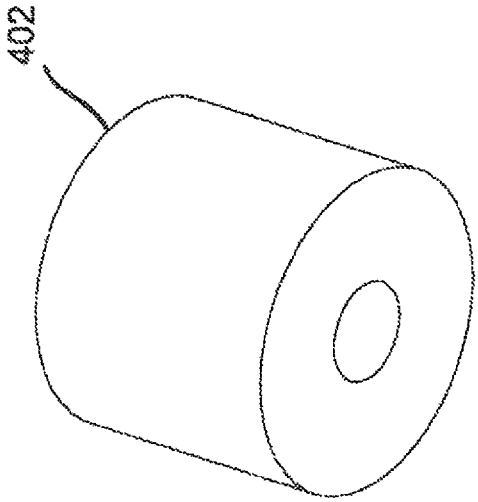

FIGS. 12A through 12C are perspective, front, and top views respectively of the mandrel 402 of FIG. 3B.

Figure 13A:
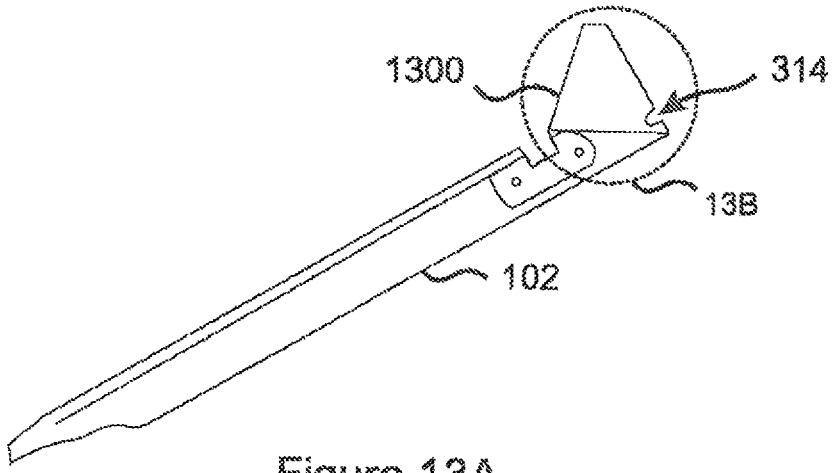
FIG. 13A is a side view of a guidance wing configured for use with the embodiment of FIG. 3B.
Figure 13B:
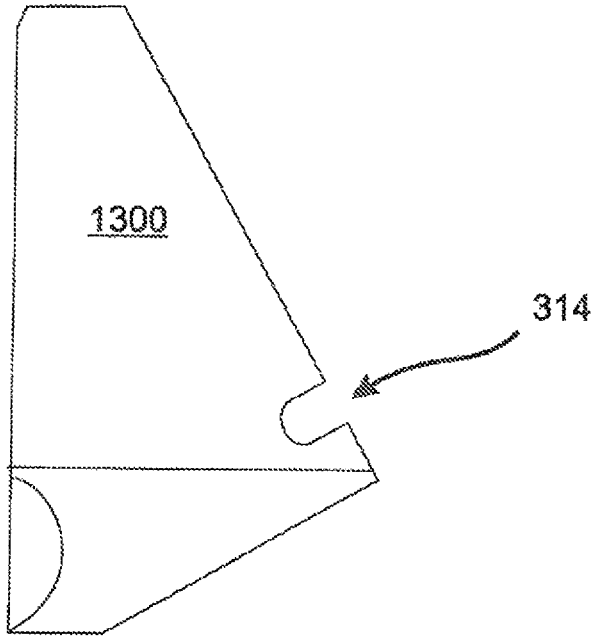
FIG. 13B is a close-up side view of the tip of the guidance wing of FIG. 13A, showing a notch used to secure the wing in the folded and stowed configuration.

With reference to FIG. 13A, the guidance wings 102 of missiles 100 such as the APKWS typically include variable pitch "flaperons" 1300 which are used to control the direction of flight of the missile. In the case of the APKWS, it is the flaperons 1300 which are engaged in retaining the guidance wings 102 in their folded and stowed configuration. FIG. 13B is a close-up view of the flaperon region of a guidance wing

102 used with the embodiment of FIG. 3B. When the wing is stowed, a tab from the aft retainer is inserted into a notch 306 in the flaperon.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A wing deployment assisting mechanism for increasing an initial deployment force applied to a guidance wing of a rocket or missile so as to propel the guidance wing outward from a stowed configuration at least through an initial phase of movement toward a deployed configuration of the guidance wing, the wing deployment assisting mechanism comprising:

at least one lever arm pivotally fixed to the rocket or missile, the lever arm being distinct and separate from the guidance wing, but cooperative with the guidance wing so as to propel the guidance wing outward from the stowed configuration when the lever arm is pivoted outward, the lever arm being separated from the guidance wing and providing no support to the guidance wing when the guidance wing is in the deployed configuration; and at least one torsion spring cooperative with the lever arm and configured to apply a deploying force tending to pivot the lever arm outward.

2. The wing deployment assisting mechanism of claim 1, wherein the torsion spring is an extreme duty torsion spring.

3. The wing deployment assisting mechanism of claim 1, wherein the rocket or missile includes N guidance wings, 2N lever arms and 2N torsion springs, where N is an integer greater than 1, each of the guidance wings being propelled by two corresponding lever arms and two corresponding torsion springs.

4. The wing deployment assisting mechanism of claim 3, wherein the 2N lever arms and 2N torsion springs are included in N compact assemblies, each compact assembly including two of the lever arms and two of the torsion springs, one of the lever arms in each compact assembly being a first lever arm and the other of the lever arms being a second lever arm, one of the torsion springs in each compact assembly being a first torsion spring and the other of the torsion springs being a second torsion spring.

5. The wing deployment assisting mechanism of claim 4, wherein one of the compact assemblies is located between each pair of adjacent guidance wings.

6. The wing deployment assisting mechanism of claim 5, wherein for each of the compact assemblies, the first torsion spring and the first lever arm apply a deploying force to the guidance wing on a first side of the compact assembly, and the second torsion spring and the second lever arm apply a deploying force to the guidance wing on a second side of the compact assembly.

7. The wing deployment assisting mechanism of claim 6, wherein for each of the compact assemblies the first and second lever arms pivot about axes which differ in angle by 360°/N.

8. The wing deployment assisting mechanism of claim 1, wherein the deploying force is sufficient to enable the guidance wing to break through a frangible seal covering a wing slot in a fuselage of the rocket or missile.

9. The wing deployment assisting mechanism of claim 1, wherein the mechanism applies at least 24 pounds of deploying force to the wing at the end of a spring travel of 0.30 inches.

10. The wing deployment assisting mechanism of claim 1, wherein the rocket or missile includes N guidance wings, N being an integer greater than 1, and the entire wing deployment assisting mechanism for all of the N guidance wings weighs less than 0.5 pounds.

11. The wing deployment assisting mechanism of claim 1, wherein the rocket or missile includes N guidance wings, N being an integer greater than 1, and the wing deployment assisting mechanism occupies less than 2.5 cubic inches per guidance wing.

12. The wing deployment assisting mechanism of claim 1, wherein the lever arm remains internal to a main assembly of the rocket or missile during deployment of the guidance wing to the deployed configuration.

* * * * *